United States Patent [19]

Malyshev et al.

[11] 3,934,568

[45] Jan. 27, 1976

[54] CRANKSHAFT GOVERNOR OF AN INTERNAL COMBUSTION ENGINE

[76] Inventors: Leonid Mikhailovich Malyshev, ulitsa Belinskogo, 28, kv. 30; Lev Iosifovich Indrupsky, ulitsa Avtozavodskaya, 69, kv. 13; Boris Pavlovich Gusev, ulitsa Eleny Kolesovoi, 68, kv. 98; Yakov Borisovich Pisman, ulitsa Volodarskogo, 105, kv. 36, all of Yaroslavl, U.S.S.R.

[22] Filed: July 23, 1974

[21] Appl. No.: 491,053

[52] U.S. Cl. ..... 123/140 R

[51] Int. Cl.[2] ..... F02D 1/04

[58] Field of Search ..... 123/139 R, 140 R

[56] References Cited

UNITED STATES PATENTS

| | | | |
|---|---|---|---|
| 2,779,289 | 1/1957 | Hogeman | 123/139 R |
| 2,882,884 | 4/1959 | Scheiterlein | 123/140 R |

FOREIGN PATENTS OR APPLICATIONS

| | | | |
|---|---|---|---|
| 851,433 | 3/1960 | United Kingdom | 123/140 R |

*Primary Examiner*—Charles J. Myhre
*Assistant Examiner*—Ronald B. Cox
*Attorney, Agent, or Firm*—Waters, Schwartz & Nissen

[57] ABSTRACT

An internal combustion engine crankshaft governor disposed between the banks of angularly related sections of a fuel pump and comprising a crosspiece with centrifugal flyweights rotated by the crankshaft of the engine. The fly-weights act on a coupling and therethrough on a double-arm lever connected with one of the pump rack bars controlling fuel supply and balanced by a spring. The double-arm lever is rotatably mounted on a pivot spindle secured in the pump housing and positioned normally to the plane passing through the longitudinal axes of the rack bars. The tension of the spring is controlled by the angle through which a control lever turns. The control lever is rotatably mounted on another pivot spindle secured in the pump housing and positioned normally to the plane passing through the longitudinal axes of the rack bars.

1 Claim, 3 Drawing Figures

CRANKSHAFT GOVERNOR OF AN INTERNAL COMBUSTION ENGINE

The present invention relates to internal combustion engines, and, more particularly, to a crankshaft governor of an internal combustion engine.

The governor of the present invention may be employed most advantageously in transportation vehicle diesel engines whereof the cylinders are angularly related, e.g. in a V-type engine with the cylinders arranged in two rows forming the V.

The advent of V-style mechanisms and the urgent need to cut back the engine length have brought forth sophisticated layouts of engine and automobile units such as the generator, the air bake compressor, the hydraulic steering booster pump, the fuel supply mechanism, etc., which are desirably disposed in the space between the two rows of banks of cylinders which form the V of the engine, so that space in this area is at a premium, calling for compactness of design of the various engine parts so positioned, particularly of the multisection fuel pump with a governor which, in an in-line design, usually takes about two-thirds of the length of the V.

It is not accidental therefore that fuel pumps whereof the sections are arranged in two rows forming a V have gained a strong foothold in the diesel-engine manufacturing industry. Such an arrangement permits cutting back the pump length substantially, but also provides for its high reliability because this design may employ the main parts of in-line pumps having an excellent service record.

As a rule, a V-style fuel pump with in-line banks of angularly related sections is regulated by a crankshaft governor positioned on the end of the pump; usually, it is an in-line pump governor incorporating some additional elements required to control the two rack bars of the pump.

Thus, for instance, Bosch Co. employs a standard inline pump governor in a V-style fuel pump of the type PESV 8P 90 A 320 LS. This governor takes more than half of the length of an eight-section in-line pump, so that length reduction due to the V-type arrangement gives a cutback of the overall length of the fuel mechanism by only 25 or 30 percent.

It is already known in the art to employ an internal combustion engine crankshaft governor which is disposed between two banks of angularly related fuel pump sections (according to the patent granted to Caterpillar Tractor Co. in the United Kingdom, No.851, 433, Cl. 7(3) B2 11A). The latter governor having no housing of its own is secured to the housing of the fuel pump formed V-style as two angularly related banks of pump sections.

Figure 1:
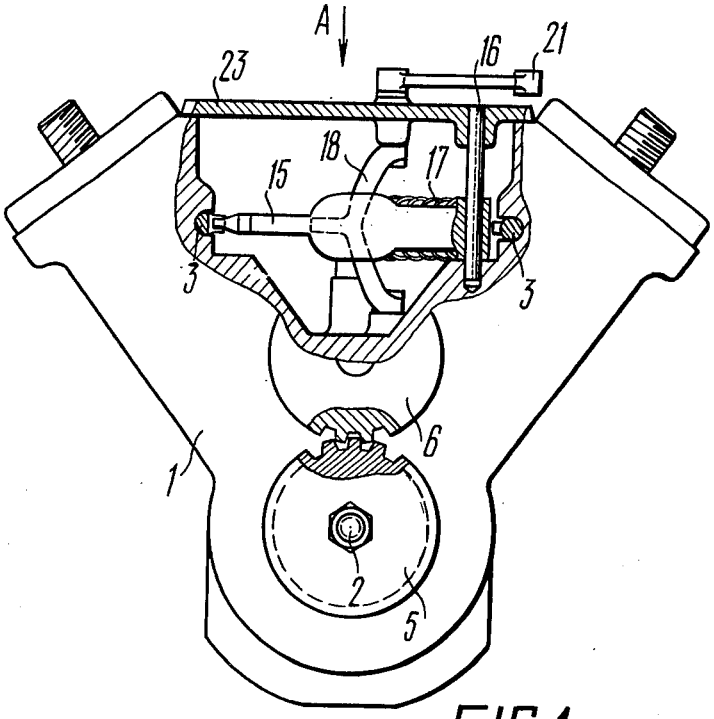
FIG. 1 shows a frontal view of the v-type fuel injection pump showing the governor drive and components.

The pump plungers are actuated by a single camshaft mounted in the middle portion of the pump housing. Fuel supply is controlled by two rack bars interconnected by a gear train so that, upon movement of one rack bar in response to governor action, the other rack bar is moved equally and in the opposite direction.

The governor comprises a crosspiece whereto are attached centrifugal flyweights rotated by the crankshaft through a gear train. The governor also comprises a coupling kinematically linked with one of the rack bars controlling fuel supply. Spreading of the flyweights in response to engine speed imparts sliding movement to the coupling formed as a reciprocable spindle which movement is resisted by a main spring whose tension depends on the angle through which a control lever turns as set by the operator.

The control lever is mounted on a shaft whereof the axis is parallel to the plane passing through the longitudinal axes of the rack bars in the upper projecting portion of the pump housing.

The governor is connected with one of the rack bars of the pump through the spindle of the coupling and a double-arm lever whereof the pivot spindle runs parallel to the plane passing through the longitudinal axes of the rack bars.

The double-arm lever and the fulcrum thereof are disposed on the end portion of the pump housing and enclosed in a special projecting case.

The foregoing arrangement of the governor partly disposed between the banks of fuel pump sections allowed of reducing the overall length of the fuel pump-and-governor assembly.

However, with the control lever traditionally disposed on a pivot spindle parallel to the plane passing through the longitudinal axes of the rack bars in the upper compartment of the fuel pump housing, the fuel pump-and-governor arrangement has to be made larger in the vertical dimension.

And with the double-arm lever transmitting motion from the coupling to one of the rack bars mounted on the end portion of the pump housing on a pivot spindle which is parallel to the plane passing through the longitudinal axes of the rack bars, a special projecting lug is required which adds to the length of the fuel pump-and-governor arrangement.

The above-described disadvantages, viz. increased height and length of the fuel pump-and-governor arrangement, could be remedied, the more so since there is a substantial unused space in the front compartment of the pump housing.

The aforementioned disadvantages of the known governor render the fuel pump-and-governor arrangement more cumbersome and add to the overall weight of the engine; besides, little room for monouvre is left for mounting other units on the engine.

It is an object of the present invention to provide a compact governor that could be disposed entirely between the banks of fuel pump sections without adding to the overall size of the fuel pump-and-governor arrangement.

It is another object of the present invention to provide a simplified design of the mechanism linking the governor coupling with the rack bar of the fuel pump.

With these and other objects in view, the inventive concept resides in that in an internal combustion engine crankshaft governor disposed between the banks of angularly related sections of a fuel pump, comprising a crankshaft-rotated member with centrifugal flyweights actuating, through a coupling, a lever rotatably mounted on a pivot spindle and linked with one of the rack bars of the pump which control fuel supply and balanced by a spring, the tension thereof being adjusted by a control lever rotatably mounted on a pivot spindle, in accordance with the invention, the pivot spindle of the lever cooperating with the coupling and the pivot spindle of the control lever are disposed normally to the plane passing through the longitudinal axes of the rack bars.

Such an arrangement of the pivot spindles of the levers permitted the levers and all other elements of the governor to be disposed in the space between the banks of fuel pump sections without adding to the overall size of the fuel pump-and-governor arrangement.

Since the movement of the lever cooperating with the coupling and the movement of the rack bars are executed in parallel planes, with the lever pivot spindle being disposed normally to thd plane passing through the axes of the rack bars; one of the rack bars may be directly coupled with said lever, thereby considerably simplifying the connection of the governor coupling with the rack bar.

Other objects and advantages of the present invention will become apparent from the following detailed description of exemplary embodiments thereof taken in conjunction with the accompanying drawings.

The internal combustion engine crankshaft governor of this invention is disposed between the banks of sections of a V-style fuel pump.

The governor has no housing of its own and is fixed on a pump housing 1 (FIG. 1).

The pump housing 1 comprises two banks of angularly related fuel pump sections which extend into a common crankcase for a cam shaft 2 which il coupled with a crankshaft (not shown).

A pair of rack bars 3, whose operation is synchronized by means of an equal-arm lever 4 (FIG. 2) disposed between the banks of fuel pump sections moves, turning a plunger (not shown) with a scroll edge thereby metering the amount of fuel injected into the cylinders of the engine.

The governor is rotated by the camshaft 2 of the pump through a driving gear 5 (FIG. 1) and an intermediate gear 6. A driven gear 7 (FIG. 2) which meshes with the intermediate gear 6 (FIG. 1) is formed integrally with a crosspiece 8 (FIG. 2) which serves as a member carrying centrifugal flyweights 9 pivotally mounted on pivot spindles 10. The flyweights 10 may turn through a certain angle, imparting axial movement to a coupling 11 which is slidably mounted in a recess formed in the crosspiece 8. The crosspiece 8 is supported by two bearings 12 and 13 installed in the recesses provided in the back cover indicated at 14 and in the housing 1.

A double-arm lever 15 rotatably mounted on a pivot spindle 16 is in contact with the coupling 11. The pivot spindle 16 of the lever 15 is secured in the pump housing 1 normally to the plane passing through the longitudinal axes of the rack bars 3.

The lever 15 has one arm connected with the pump rack bar 3, while the other arm of the lever 15 is connected with a spring 17 balancing the effort of the flyweights 9, the tension of the spring 17 being adjusted by a lever 18 mounted on a pivot spindle 19 and connected with shaft 20 (FIG. 3) of a control lever 21, the pivot spindle 19 being secured in the pump housing 1.

Figure 2:
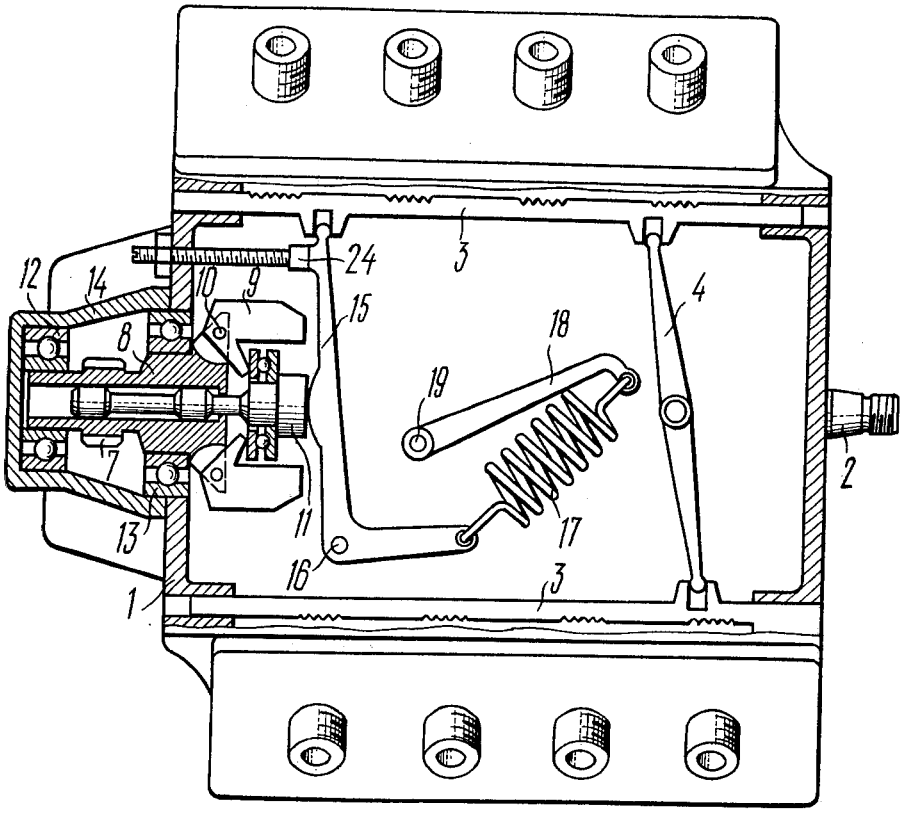
FIG. 2 is a top view of the injection pump showing governor mechanism between the pump banks.

The levers 18 and 21 are not designed to undergo relative angular displacement; they turn as a single unit. The pivot spindle 19 of the lever 18 of the spring 17 and the shaft 20 of the control lever 21 have a common geometrical axis which is perpendicular to the plane passing through the longitudinal axes of the rack bars 3 (FIG.2).

Figure 3:
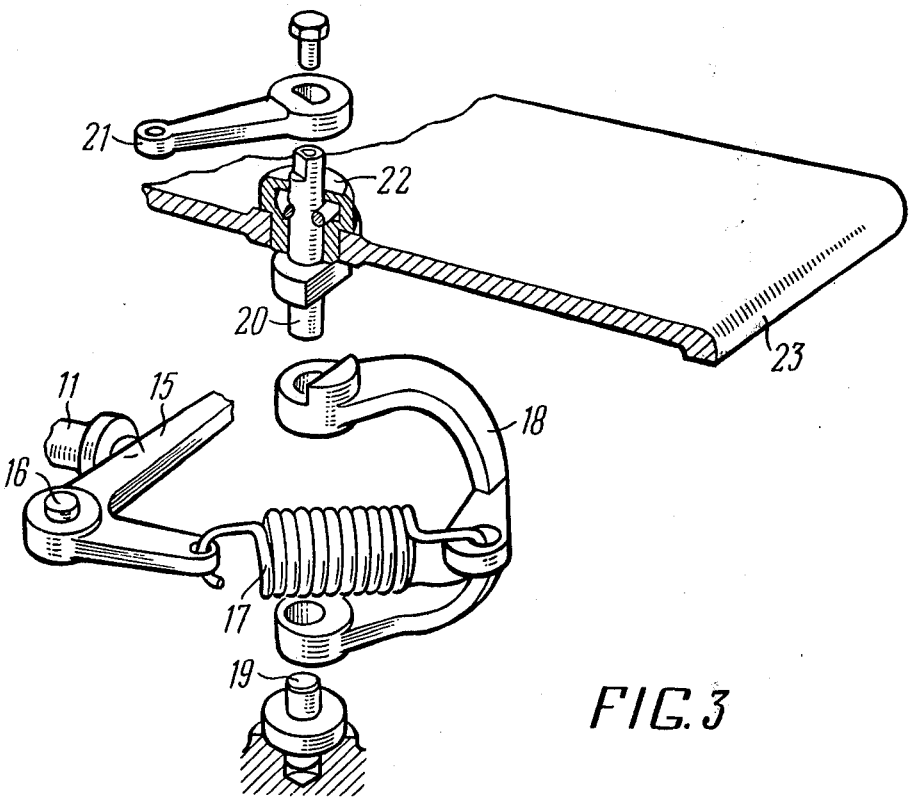
FIG. 3 is an exploded perspective view of part of the governor mechanism.

The shaft bearing of the shaft 20, which is indicated at 22 in FIG.3, is positioned in upper cover 23 of the pump housing 1 (FIG.1) which spans the space between the banks of fuel pump sections.

A lead screw 24 (FIG.2) for controlling the amount of fuel subjected into the engine cylinders limits the extent of displacement of the lever 15 and, hence, of the pump rack bars 3 in the direction of increased injection volume.

The mechanism increasing fuel supply for engine startup and the mechanism cutting off fuel supply are not essential and therefore are omitted from the illustrations; but they are likewise positioned between the banks of fuel pump sections, and the pivot spindles of their levers are perpendicular to the plane passing through the longitudinal axes of the rack bars 3.

The following describes the operation of the proposed governor under various operating conditions of the internal combustion engine.

At the engine start-up, the rack bars 3 (FIG.2) of the pump are set to a position corresponding to maximum fuel supply into the engine cylinders.

As soon as all the cylinders are operative, the speed of the crankshaft sharply rises, for a great amount of fuel is being injected into the cylinders while the engine experiences no loading.

As the speed of the crankshaft increases so do the centrifugal forces of the governor flyweights 9 which overcome the resistance of the spring 17 to displace the coupling 11, the lever 15 and the pump rack bars 3 in the direction of diminishing fuel supply.

The fuel supply decreases continues until a balance is struck between the effort of the flyweights 9 and the tension of the spring 17, corresponding to the amount of fuel supply necessary for the operation of the engine at no load.

Depending on the angle through which the control lever 21 turns the no-load speed of rotation will vary, and the greater this angle the higher is the tension of the spring 17 and the higher is the no-load speed of rotation of the crankshaft.

Thus, in an automobile diesel engine, the control lever 21 is connected with the accelerator pedal through a drive, so that the driver controls the speed of the engine crankshaft by setting the accelerator pedal to required positions.

When the engine is working under load, the governor automatically sets the required amount of fuel supply depending on the load, thereby maintaining the speed of rotation of the crankshaft set by the operator by means of the control lever 21.

Thus, for example, when the automobile is sharply accelerating or running up a steep incline, the speed of rotation of the crankshaft starts decreasing, causing a decrease in the centrifugal forces of the flyweights 9. At that instant the tension of the spring 17 overcomes the effort of the flyweights 9 transmitted to the coupling 11, so that the lever 15 turns, drawing together the flyweights 9 and driving the rack bars 3 in the direction of increased fuel supply up to the rated value.

In case of reduced load on the engine corresponding to the automobile riding downhill or to the driver reducing the tension of the spring 17, the engine receives excess fuel and steps up its rpm. Then the rising centrifugal forces of the flyweights 9 overcome the resistance of the spring 17 and drive the coupling 11, the lever 15 and the rack bars 3 in the direction of decreased fuel supply corresponding to the size of load.

What we claim is:

1. An internal combustion engine crankshaft governor disposed in the space between the banks of angularly related sections of a fuel pump incorporating two rack bars controlling fuel supply, comprising: a crosspiece rotated by said crankshaft of the internal combustion engine; centrifugal flyweights; pivot spindles for mounting said flyweights on said crosspiece; a coupling for converting the rotary movement of said centrifugal flyweights to the translatory movement of said two rack bars of said fuel pump controlling fuel supply; a double-arm lever actuated by said centrifugal flyweights through said coupling and having one arm connected with one of said rack bars of said fuel pump; a pivot spindle secured in the housing of said pump and positioned normally to the plane passing through the longitudinal axes of said rack bars, said pivot spindle carrying said lever rotatably mounted thereon; a spring for balancing the effort of said lever having one end connected with the other arm of said lever; a control lever for adjusting the tension of said spring connected with the other end of said spring; one more pivot spindle secured in the housing of said pump, positioned normally to the plane passing through the longitudinal axes of said rack bars and carrying said control lever rotatably mounted thereon.

* * * * *